US010589951B2

(12) United States Patent
Tsujimoto

(10) Patent No.: US 10,589,951 B2
(45) Date of Patent: Mar. 17, 2020

(54) METHOD AND SYSTEM FOR REMOVING OUTER LAYER OF ROLLSTOCK

(71) Applicant: ZUIKO CORPORATION, Osaka (JP)

(72) Inventor: Yoshiaki Tsujimoto, Osaka (JP)

(73) Assignee: ZUIKO CORPORATION, Osaka (JP)

( * ) Notice: Subject to any disclaimer, the term of this patent is extended or adjusted under 35 U.S.C. 154(b) by 0 days.

(21) Appl. No.: 16/090,810

(22) PCT Filed: Apr. 13, 2017

(86) PCT No.: PCT/JP2017/015112
§ 371 (c)(1),
(2) Date: Oct. 2, 2018

(87) PCT Pub. No.: WO2017/183552
PCT Pub. Date: Oct. 26, 2017

(65) Prior Publication Data

US 2019/0092595 A1 Mar. 28, 2019

(30) Foreign Application Priority Data

Apr. 18, 2016 (JP) ..... 2016-082652

(51) Int. Cl.
*B65H 19/10* (2006.01)
*B26D 3/00* (2006.01)

(52) U.S. Cl.
CPC ..... *B65H 19/105* (2013.01); *B26D 3/00* (2013.01); *B65H 19/10* (2013.01)

(58) Field of Classification Search
CPC ..... B65H 19/105; B65H 35/04; B65H 19/10
See application file for complete search history.

(56) References Cited

U.S. PATENT DOCUMENTS 6,227,088 B1 * 5/2001 Cestonaro ..... B65H 19/105 242/523.1
6,339,982 B1 * 1/2002 Angel ..... B26D 1/025 400/621

(Continued)

FOREIGN PATENT DOCUMENTS

JP H04-44940 A 2/1992
JP H04-49152 A 2/1992

(Continued)

OTHER PUBLICATIONS

International Search Report Issued in PCT/JP2017/015112 dated Jun. 13, 2017.

*Primary Examiner* — Omar Flores Sanchez
(74) *Attorney, Agent, or Firm* — Renner, Otto, Boisselle & Sklar, LLP

(57) ABSTRACT

A method for removing outer layer of rollstock includes: first step of cutting rollstock's outermost circumferential film in a first cut portion, the rollstock formed by a film sheet rolled from base end to tip end and the tip end temporarily fixed to an outer circumferential surface; second step of cutting the film in a second cut portion closer to the base end than the first cut portion, a length from the tip end to the second cut portion being equal to or more than one round of the rollstock's outermost circumference; and step of discarding a first cut-film piece from the first cut portion to the tip end and a second cut-film piece from the first cut portion to the second cut portion by drawing the first and second pieces with a drawing device while driving an unwinding roller mounted with a hollow portion of the rollstock to rotate.

12 Claims, 12 Drawing Sheets

(56) References Cited

U.S. PATENT DOCUMENTS

| | | | | |
|---|---|---|---|---|
| 6,811,637 | B2 * | 11/2004 | Pelagatti | B65H 19/105<br>156/157 |
| 2002/0189746 | A1 * | 12/2002 | Kuta | B65H 19/102<br>156/157 |
| 2003/0015296 | A1 * | 1/2003 | Pelagatti | B65H 19/105<br>156/504 |

FOREIGN PATENT DOCUMENTS

| | | | |
|---|---|---|---|
| JP | H06-81915 | U | 11/1994 |
| JP | H08-40426 | A | 2/1996 |
| JP | H08-113397 | A | 5/1996 |
| JP | H08-113399 | A | 5/1996 |
| JP | 2011-189570 | A | 9/2011 |

* cited by examiner

METHOD AND SYSTEM FOR REMOVING OUTER LAYER OF ROLLSTOCK

TECHNICAL FIELD

The present invention relates to a method and system for removing an outermost layer of a rollstock in which a film such as a resin film, a nonwoven fabric, or a liquid absorbing paper is wound in a roll shape.

BACKGROUND ART

Many materials of disposable wearable articles such as, for example, paper diapers or sanitary napkins are sheet-like materials obtained by cutting a rollstock. When such sheet-like materials are produced, a film is wound off from the rollstock. A portion of an outermost layer of a length of one round in the outermost circumference of the rollstock is easy to be soiled or damaged during transportation, and therefore, needs to be removed.

CITATION LIST

Patent Literature

[Patent Literature 1] Japanese Patent Application Publication No. 08-40426 (Abstract)

[Patent Literature 2] Japanese Patent Application Publication No. 08-113399 (FIG. 1)

[Patent Literature 3] Japanese Patent Application Publication No. 04-44940 (FIG. 14)

[Patent Literature 4] Japanese Utility Model Application Publication. No. 06-81915 (Abstract)

SUMMARY OF INVENTION

Processing of the article described above is generally automatically performed, which results in productivity improvement. However, the patent literatures described above do not disclose enough a method for removing an outermost layer of the rollstock.

Thus, an object of the present invention is to provide a method and a system for removing an outermost layer of a rollstock, that contribute to automation.

The method for removing an outer layer of a rollstock (a raw material roll) of the present invention includes:

a first cutting step of cutting a film S of a rollstock R in an outermost circumference of the rollstock R along an overall width of a width direction W in a first cut portion C1 in the outermost circumference of the rollstock R, the rollstock R formed by rolling (winding) the film S from a base end Sb of the film S to a tip end Se of the film S into the rollstock R and then temporarily fixing the tip end Se to an outer circumferential surface Rf of the rollstock R;

a second cutting step of cutting the film S along the overall width of the width direction W, in a second cut portion C2 closer to the base end Sb than the first cut portion C1, a virtual length of the film S from the tip end Se to the second cut; portion C2 before the cutting steps being equal to or more than a virtual length of one round of the outermost circumference of the rollstock R before the cuttings steps; and a step of discarding a first cut piece S1 of the film S extending to the tip end Se from the first cut portion C1 and a second cut piece S2 of the film S extending to the second cut portion C2 from the first cut portion C1 by drawing the first cut piece S1 and the second cut piece S2 with a drawing device 3 while driving an unwinding roller 9 mounted with a hollow portion Rc of the rollstock R to rotate.

According to the present invention, the first cut piece S1 of the film S up to the tip end Se from the first cut portion C1 is generated by the first cutting step. On the other hand, the second cut piece S2 up to the second cut portion C2 from the first cut portion C1 is cut out from the film S by the second cutting step. In the discarding step, while the unwinding roller 9 is driven to rotate, the first cut piece S1 and the second cut piece S2 are drawn by a blower 3 and discarded. Automation of removal of an outermost layer of a film can be performed by the steps. Since the length of the film up to the second cut portion C2 from the tip end Se of the film S is equal to or more than the length of the one round of the outermost circumference of the rollstock R, an outermost layer Rs can be reliably removed.

The removal system of an outer layer of a rollstock of the present invention includes: an unwinding roller 9 mounted with a hollow portion Rc of a rollstock R, the rollstock R formed by rolling a film S from a base end Sb of the film S to a tip end Se of the film S into the rollstock R;

a first cutter 11 that; cuts the film S in an outermost circumference of the rollstock R along an overall width of a width direction W in a first cut portion C1 in the outermost circumference of the rollstock R mounted in the unwinding roller 9;

a suction device 31 that sucks with a negative pressure a first end S11 continuing to the base end Sb of the film S and draws the first end S11 from the rollstock R, the first end S11 being one of a pair of ends of the film S, the pair of ends formed by cutting the film S by the first cutter 11; and a second cutter 21 that cuts the film S drawn by the suction device 31 along the overall width of the width direction W, in a second cut portion C2.

According to the present system, the first cutting step is performed by the first cutter 11, the end generated by this cutting is drawn from the rollstock R by the suction device 31, then, the second cutting step is performed, and the first and second cut; pieces S1, S2 are sucked by the suction device 31 and are discarded.

Thus, automation of removal of an outermost layer can be easily realized.

DESCRIPTION OF EMBODIMENTS

Figure 1:
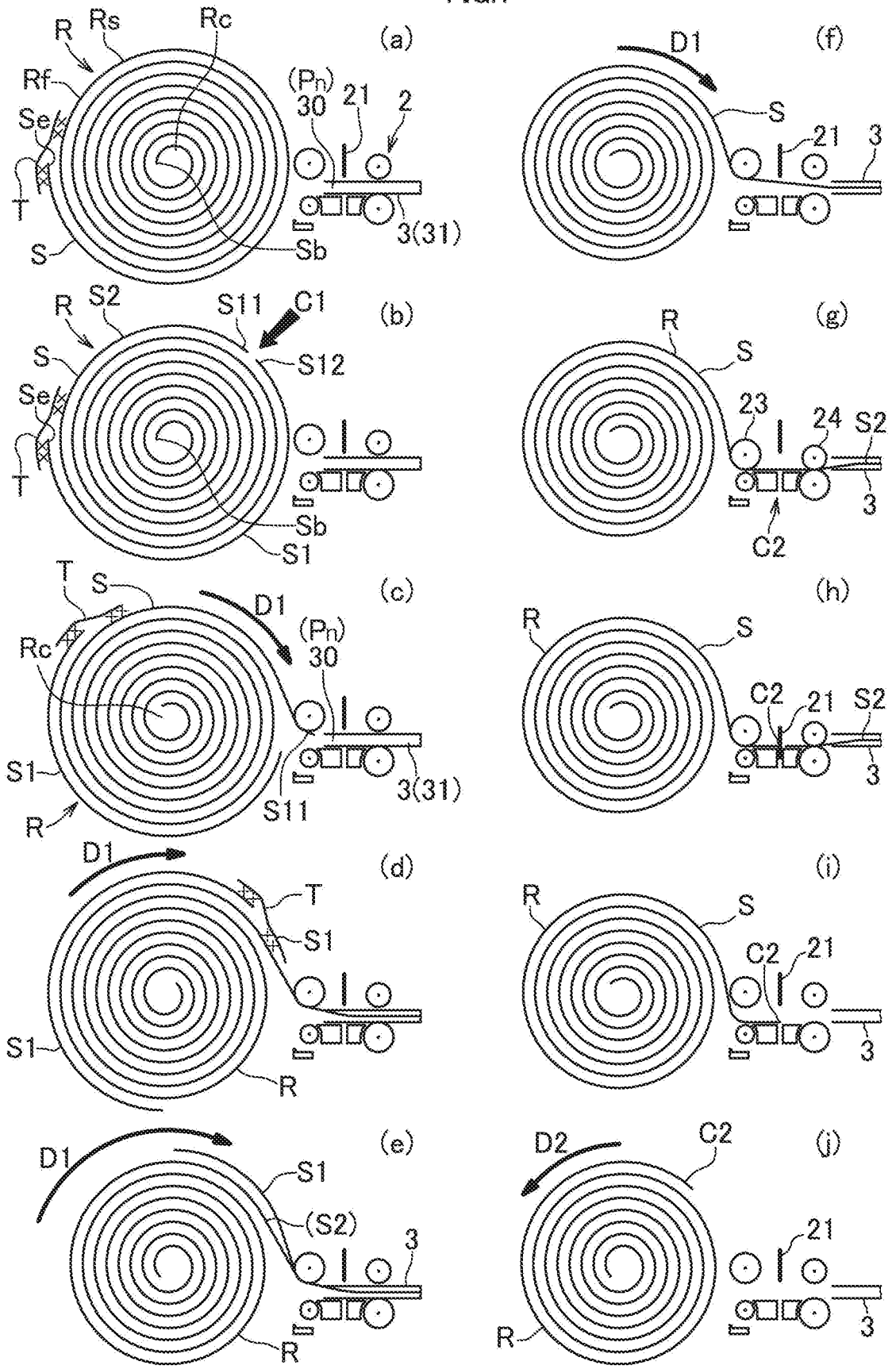
FIG. 1 is a process drawing showing First Example of a removal method of an outermost layer of the present invention.

A preferred method of the present invention includes a drawing step of drawing from the rollstock R a first end S11 continuing to the base end Sb, the first end S11 being one of a pair of ends S11, S12 of the film S, the pair of ends S11, S12 formed by cutting the film S in the first cutting step, wherein the film S continuing to the first end S11 that has been drawn by the drawing step is cut in the second cut portion C2 in the second cutting step.

In this case, the first and second cut portions can be arbitrary selected, and a desired portion of the outermost layer can be removed.

It is preferable that the method includes a step of rotating the rollstock R in a first circumferential direction D1 in the drawing step; and a step of rotating the rollstock R in a second circumferential direction D2 opposite from the first circumferential direction D1 after the second cutting step.

In this case, the rollstock R is rotated in the first circumferential direction D1 so that portions corresponding to the first cut piece S1 and the second cut piece S2 are drawn from the rollstock R, and the portions are cut out in the second cutting step. After that, the rollstock R is rotated in the second circumferential direction D2, and thereby a phase of a tip end of the rollstock R can be performed with initial setting, for preparation for production of a product.

It is preferable that only an outermost layer Rs configuring the film S in the outermost circumference of the rollstock R is cut in the first cutting step, and the film S continuing from the outermost layer Rs to the base end Sb is cut in the second cutting step.

In this case, only the outermost layer Rs is cut in the first cutting step. Thus, the film S to be discarded can be minimum necessary.

It is preferable that the method includes a step of rotating the rollstock R in a first circumferential direction D1 in the drawing step, the first circumferential direction D1 set in an unwinding direction for producing a product from the film S; and a step of rotating the rollstock R in a second circumferential direction D2 opposite from the first circumferential direction D1 after the second cutting step.

In this case, smooth transition can be performed from the step of removing the outermost layer and to a step of producing a product by unwinding the film S in the unwinding direction.

When only the outermost layer is cut in the first cutting step, only the film that has been unwound can be cut in the second cutting step by rotating the film in the unwinding direction. Thus, cutting can be performed easily and reliably. On the other hand, a new tip end of the film can be set in a predetermined position by rotating the film in the opposite direction, and thereby, transition can be performed smoothly to the subsequent product producing step.

It is preferable that the rollstock R is rotatably supported around a horizontal axis line H by the unwinding roller 9, and the rollstock R is rotated such that the first end S11 of the film S moves from upward to downward in the step of rotating the rollstock R in the first circumferential direction D1.

In the present invention, the rollstock R may be rotated such that the first end S11 moves from a downward position toward an upward position in the step of rotating in the first circumferential direction D1. However, in this case, the behavior of the first end S11 moving from downward to upward is against the gravity, and therefore, the behavior of the first end S11 may be unstable. On the other hand, the behavior of the first end S11 is easy to be stabilized by rotating the rollstock R such that the first end S11 moves from an upward position toward a downward position. Thus, the drawing step would be reliably performed.

In the present invention, the rollstock may be rotatably supported around a vertical line. However, in this case, a component such as a pressing tool or the like would be necessary for preventing the film of the cut outermost layer portion from drooping.

It is preferable that a length of the film S from the first cut portion C1 to the second cut portion C2 is longer than a length of one round of the outermost circumference of the rollstock R.

In this case, the outermost layer that has possibility of being soiled or damaged can be removed easily and reliably.

It is preferable that the tip end Se of the film S of the rollstock R is temporarily fixed to the outer circumferential surface Rf of the rollstock R with a tape T, and the first and second cut portions C1, C2 are set in portions of the film S, the portions being not covered with the tape T.

In this case, the portion of the tape for temporarily fixing is not cut Thus, cutting of the film would be reliably performed.

In a preferred system of the present invention, the suction device 31 has a suction port 30, and the suction device 31 is configured such that the suction port 30 reciprocates between a distal position Pf where the suction port 30 is away from the unwinding roller 9 further than the second cutter 21, and a proximal position Pn where the suction port 30 is closer to the unwinding roller 9 than the second cutter 21.

In this case, the suction port 30 sucks the first end S11 in the proximal position Pn. Thus, the film S is easy to be drawn by the suction port 30. After the suction port 30 evacuates (retracts) to the distal position Pf, the second cutter 21 cuts the film S in the second cut portion C2. Thus, it is not necessary to move the second cutting device having a complicated structure including the second cutter 21.

It is preferable that the system further includes an air blower 32 positioned between the second cutter 21 and the unwinding roller 9, the air blower 32 separating one of the pair of ends of the film S from the rollstock R by air blowing.

In this case, the air blower 32 separates the end of the film S from the rollstock R by air, and thereby suction by the suction device 31 can be performed reliably.

It is preferable that the system further includes a first control unit 101 configured to rotate the unwinding roller 9 together with the rollstock R in the first circumferential direction D1 corresponding to an unwinding direction after cutting the film S by the first cutter 11 and until before cutting the unwound film S by the second cutter 21, and rotate the unwinding roller 9 together with the rollstock R in the second circumferential direction D2 opposite from the first circumferential direction D1 after cutting the unwound film S by the second cutter 21.

In this case, as similar to the case described above, preparation can be performed for producing the product; the production is performed by unwinding the film S from the rollstock R.

The rollstock from which the outermost layer is removed may be supplied to production of the product after being transferred from the unwinding roller to another supply axis (shaft), or may be remain in the unwinding roller for production of the product.

It is preferable that the system further includes a second control unit 102 configured to control the suction device 31 such that the suction port 30 is in the proximal position Pn before cutting the film S by the second cutter 21, and is in the distal position Pf when cutting the film S by the second cutter 21.

In this case, as similar to the case described above, the film is easy to be drawn, and it is not necessary to move the second cutting device having a complicated structure including the second cutter.

Features described and/or illustrated in association with one of the embodiments described above or examples described below can be used in the same or a similar form in one or more other embodiments or other examples, and/or in combination with or instead of features of the other embodiments or examples.

Examples

The present invention would be clearly understood from description of preferred examples below with reference to attached drawings. However, the examples and drawings are only for illustration and description, and are not to be utilized for determining the scope of the present invention. The scope of the present invention is determined only by the claims. In the attached drawings, the same component numbers in a plurality of drawings indicate the same or corresponding portions.

Example 1 of the present invention will be described below with reference to drawings.

Overview of the removal method of the outermost layer of the rollstock R will be described prior to description of a system according to Example 1.

Figure 6:
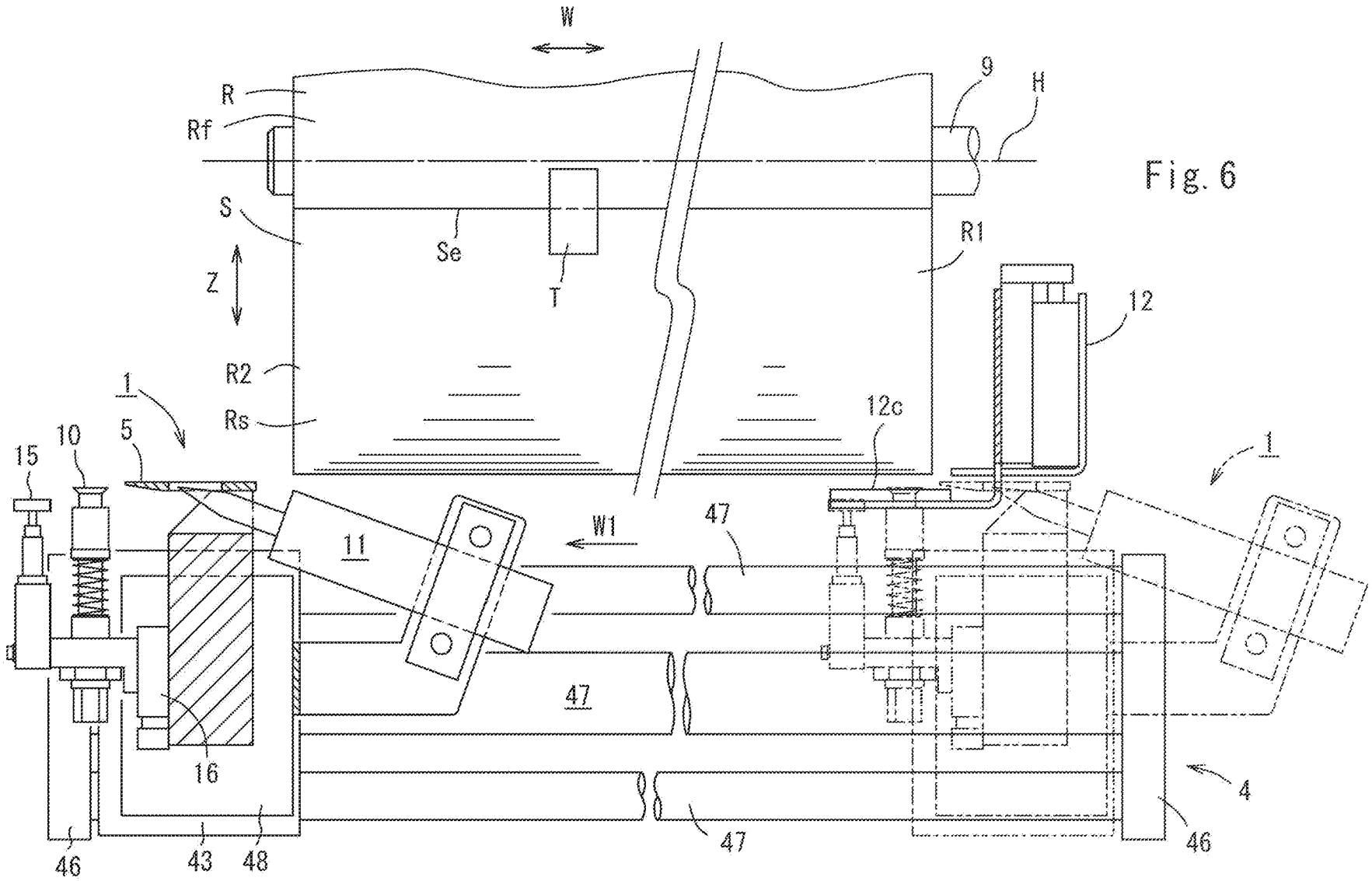
FIG. 6 is a schematic side view in partial cross-section showing a first cutting device.

As shown in FIG. 1(*a*) and FIG. 6, the tip end Se of the film S of the rollstock R, applied with the removal method of the outermost layer, is temporarily fixed to the outer circumferential surface Rf of the rollstock R with the tape T, for example. That is, in the rollstock R of FIG. 1(*a*), the film S is rolled, from its base end Sb to its tip end Se, into a roll shape and then the tip end Se is temporarily fixed to the outer circumferential surface Rf of the roll. The film S is cut in the two cut portions C1, C2 for removing the outermost layer Rs from the rollstock R. In these cuttings, the portions of the film S that are not covered with the tape T may be cut.

The removal method of the outermost layer includes a first cutting step of FIG. 1(*b*), a drawing step of FIG. 1(*c*) to (*f*), a second cutting step of FIG. 1(*h*), and a discarding step of FIG. 1(*i*).

In the first cutting step of FIG. 1(*b*), in the first cut portion C1 in the outermost circumferential of the rollstock R, the film S in the outermost circumferential of the rollstock R is cut over the overall width of the width direction W of FIG. 6.

In the drawing step of FIGS. 1(*c*) and (*d*), the first end S11 of the film S is drawn from the rollstock R of FIG. 1(*c*). The first end S11 is one of the pair of ends S11, S12 (see FIG. 1(*b*)) of the film S, the ends S11, S12 are produced by the first cutting, and the first end S11 is continuous with (or can be traced to) the base end Sb. In the drawing step, the rollstock R is rotated in the first circumferential direction D1.

In the second cutting step of FIG. 1(*h*), the unwound film S is cut over the overall width of the width direction W (FIG. 6) in the second cut portion C2 closer to the base end Sb than the first cut portion C1. The length of the film S up to the second cut portion C2 from the first cut portion C1 is a length larger (longer) than the length of one round of the outermost circumference of the rollstock R before the cuttings. In the second cutting step of FIG. 1(*g*) to (*i*), the portion of the film S continuing to the first end S11 (FIG. 1(*b*)) that has been drawn is cut in the second cut portion C2.

The length up to the second cut portion C2 from the first cut portion C1 is longer than the length of one round of the outermost circumference before the cutting steps. Thus, naturally the virtual length from the tip end Se to the second cut portion C2 is longer than the length of the one round of the rollstock's outermost circumference before the cutting steps.

In the discarding step of FIGS. 1(*c*) to (*g*) and (*i*), while the unwinding roller 9 (FIG. 4) mounted with a hollow portion Re of the rollstock R is driven to rotate, the first cut piece S1 of the film S up to the tip end Se from the first cut portion C1 of FIG. 1(*b*), and the second cut piece S2 of the film S up to the second cut portion C2 of FIG. 1(*h*) from the first cut portion C1 are drawn by the drawing device 3.

After the second cutting step, the rollstock R of FIG. 1(*j*) is rotated in the second circumferential direction D2 opposite from the first circumferential direction D1. By this rotation, initial setting of a new tip end phase of the rollstock R is performed for acquiring a product from the film S.

Next, overview of the removal system will be described.

Figure 4:
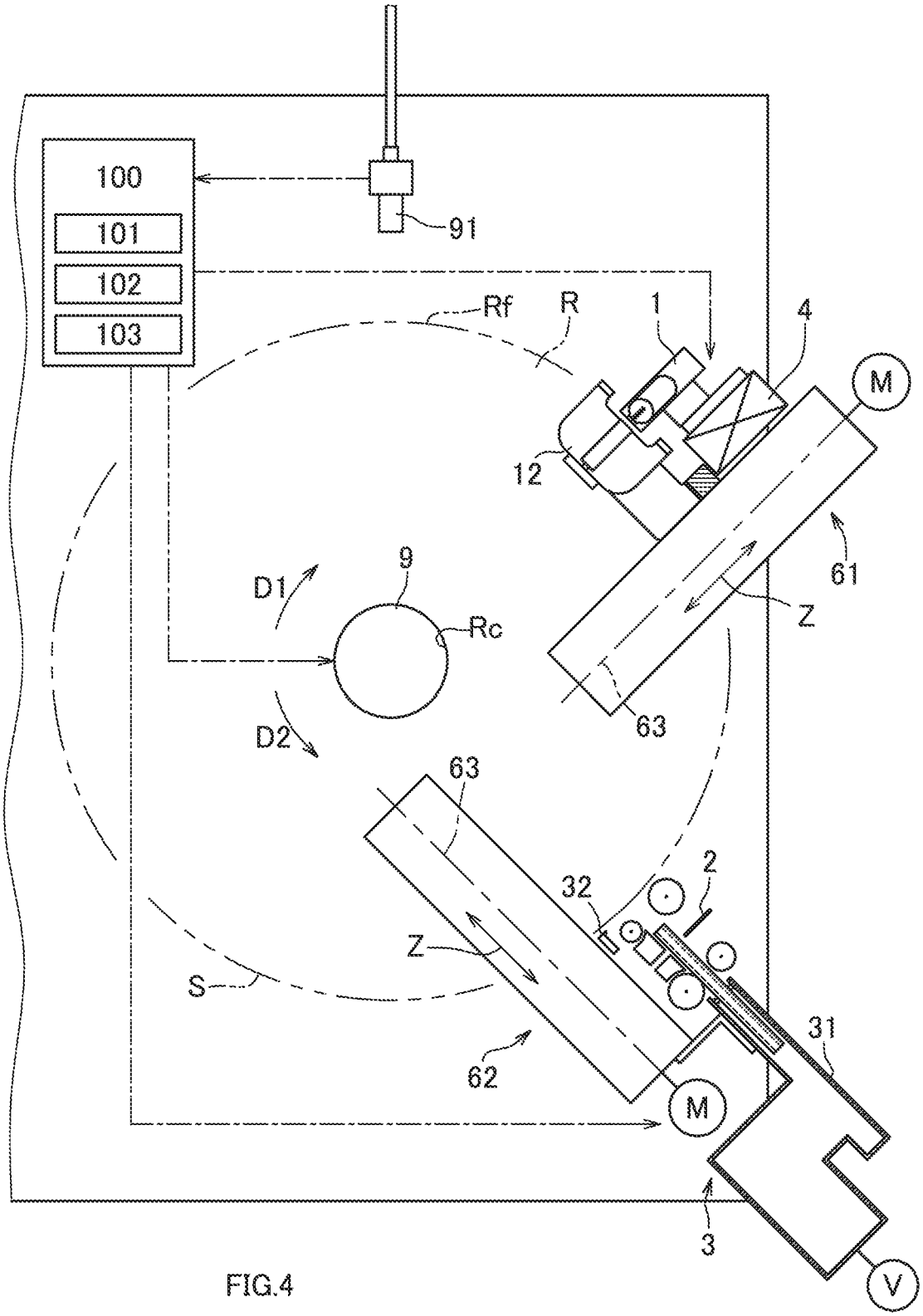
FIG. 4 is a schematic front view showing the entire removal system.

In FIG. 4, the removal system includes the first cutting device 1, the second cutting device 2, the drawing device 3, the unwinding roller 9, a sensor 91, and a control device 100. The control device 100 controls operation of the overall system in accordance with an input or the like from the sensor 91.

The control device 100 includes first, second, and third control units 101, 102, 103. As described later, each of the first, second, and third control units 101, 102, 103 controls rotation of the unwinding roller 9, the operation of the second cutting device 2, the operation of the first cutting device 1, and the like.

The sensor 91 may be provided by one or plural, and output to the control device 100 the information such as light or an ultrasonic wave reflected from the rollstock R. The control device 100 may detect a detailed outer diameter, a winding direction of the rollstock R, a position of the tip end Se of the film S, and/or a position of the tape T of FIG. 6, on the basis of the information.

The first cutting device 1 of FIG. 6 includes the first cutter 11. On the other hand, the second cutting device 2 of FIG. 3A includes the second cutter 21. The drawing device 3 includes the suction device 31.

In FIG. 4, the unwinding roller 9 is mounted with the hollow portion Rc of the rollstock R, and is driven to rotate in the first and second circumferential directions D1, D2 by a motor not shown.

The first cutter 11 of FIG. 6 cuts the film S in the outermost circumference of the rollstock R over the overall width of the width direction W of FIG. 6, in the first cut portion C1 (FIG. 1(*b*)) in the outermost circumference of the rollstock R mounted to the unwinding roller 9.

Figure 2:
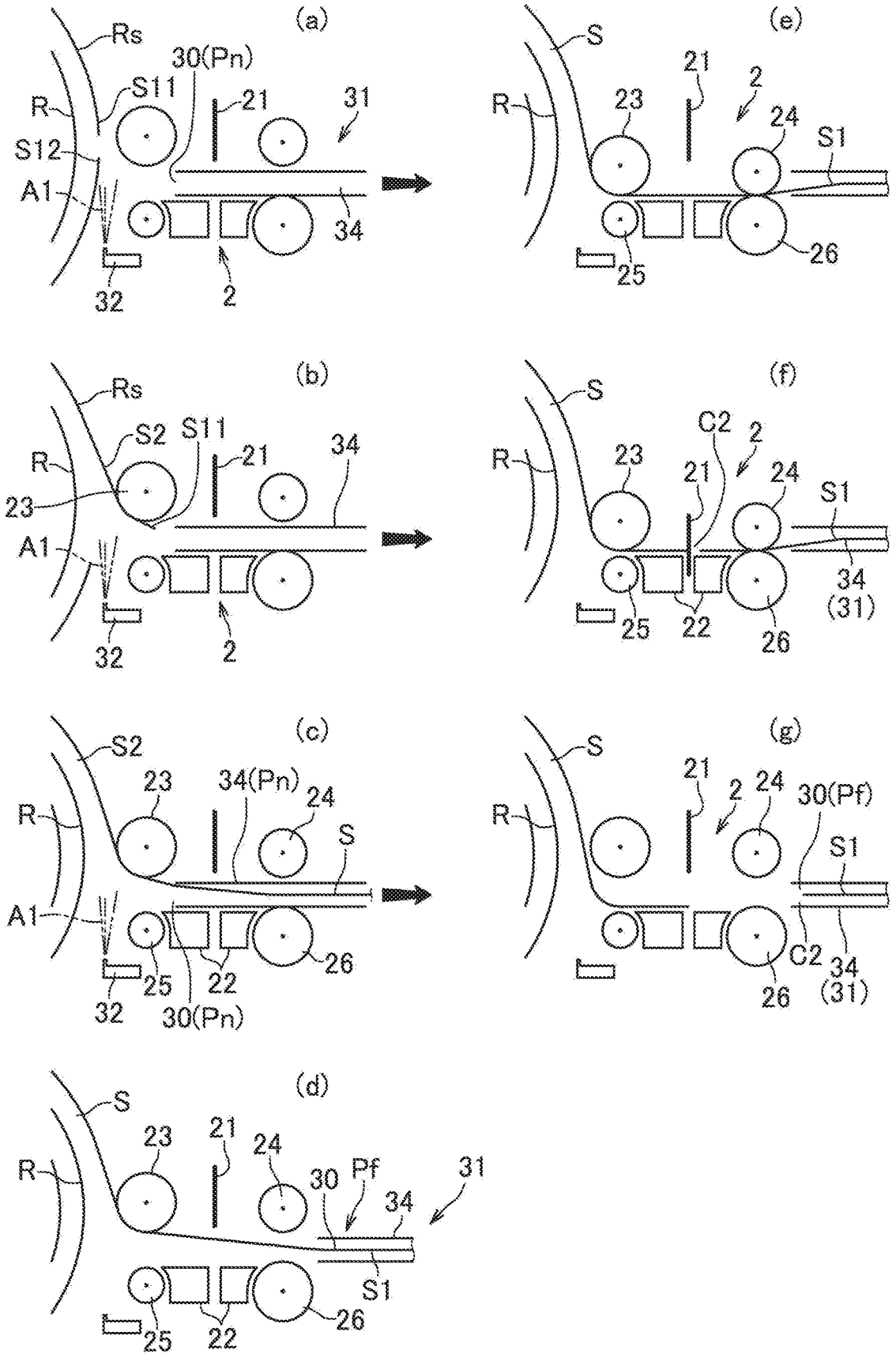
FIG. 2 is a process drawing showing a second cutting step.

As shown in FIG. 2(*a*) to (*e*), the suction device 31 sucks with a negative pressure the cut end of the film S to draw the cut end from the rollstock R. The suction device 31 has the suction port 30. The suction device 31 of FIG. 4 is configured such that the suction port 30 reciprocates between the distal position Pf of FIG. 2(*d*) to (*g*), where the suction port 30 is further away from the unwinding roller 9 (FIG. 4) than the second cutter 21, and the proximal position Pn of FIG. 2(*a*) to (*c*), where the suction port 30 is closer to the unwinding roller 9 than the second cutter 21, and the suction device 31 is controlled by the second control unit 102.

The second cutter 21 of FIG. 2(*f*) cuts the film S that has been drawn by the suction device 31 over the overall width of the width direction W of FIG. 6 in the second cut portion C2.

The removal system of FIG. 2(*a*) includes the air blower 32. The air blower 32 is arranged between the second cutter 21 and the unwinding roller 9 (FIG. 4) and separates the cut end S11 of the film S from the rollstock R by blowing of air A1.

Next, overview of an example of the first cutting device will be described.

The first cutting device 1 shown in FIG. 6 is, for example, a device that cuts the outermost layer Rs of the rollstock R of the film S formed of a resin film over the overall width of the width direction W of the film S. The resin film is air impermeable and may compose a back sheet of an absorbent body of a paper diaper or the like.

"Air impermeable" includes, in addition to a film through which air is not permeate at all, the one having slight air permeability due to minute openings or the like, such as in the case of a back seat, and means that air impermeability in an extent of capable of being absorbed (sucked) by a vacuum pad is sufficient.

The first cutting device 1 includes a vacuum pad 10, an intrusive tool 5, the first cutter 11, and a moving device 4. The moving device 4 moves the intrusive tool 5, the vacuum pad 10, the first cutter 11, and the like in the width direction W, so that the first cutter 11 can cut the outermost layer Rs along the width direction W.

Figure 9A:
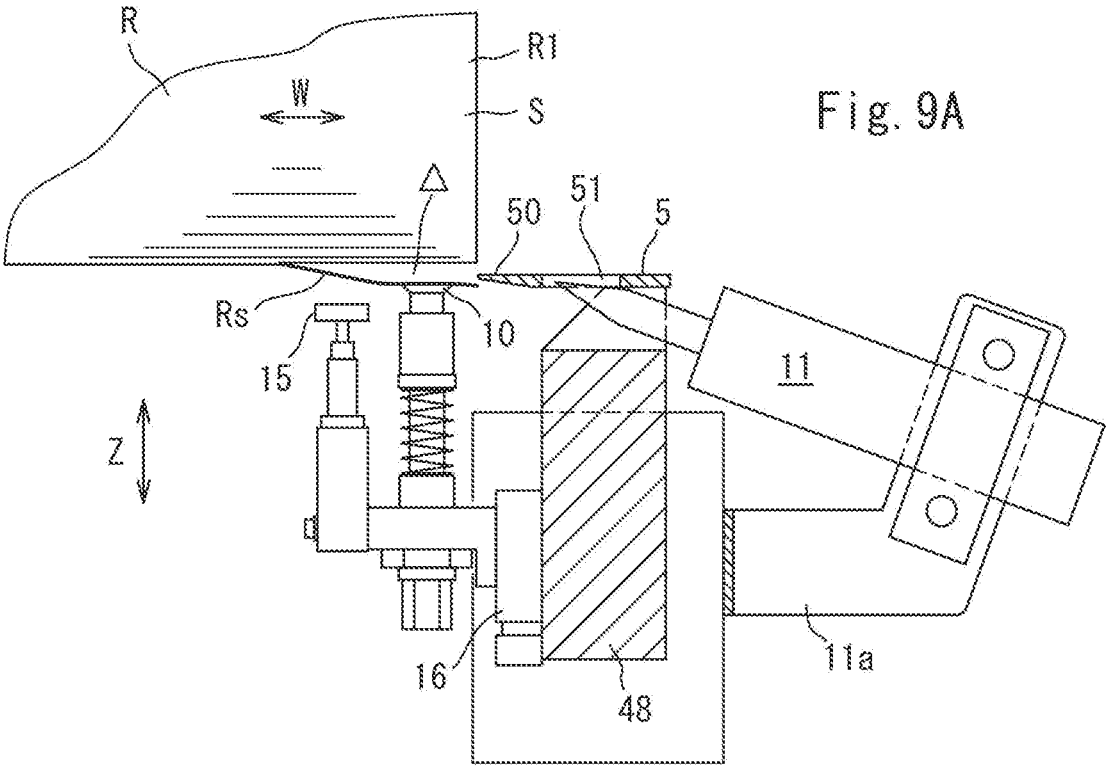
FIG. 9A and FIG. 9B are side views of the same side of the first cutting device showing the first cutting step.

As shown in FIG. 9A, the vacuum pad 10 is arranged in a first edge portion R1 of the width direction W of the rollstock R, and absorbs (sucks) the outermost layer Rs such that an air gap Δ (a gap Δ) is generated in between the outermost layer Rs and the film S in an inner circumferential side of the outermost layer Rs.

Figure 9B:
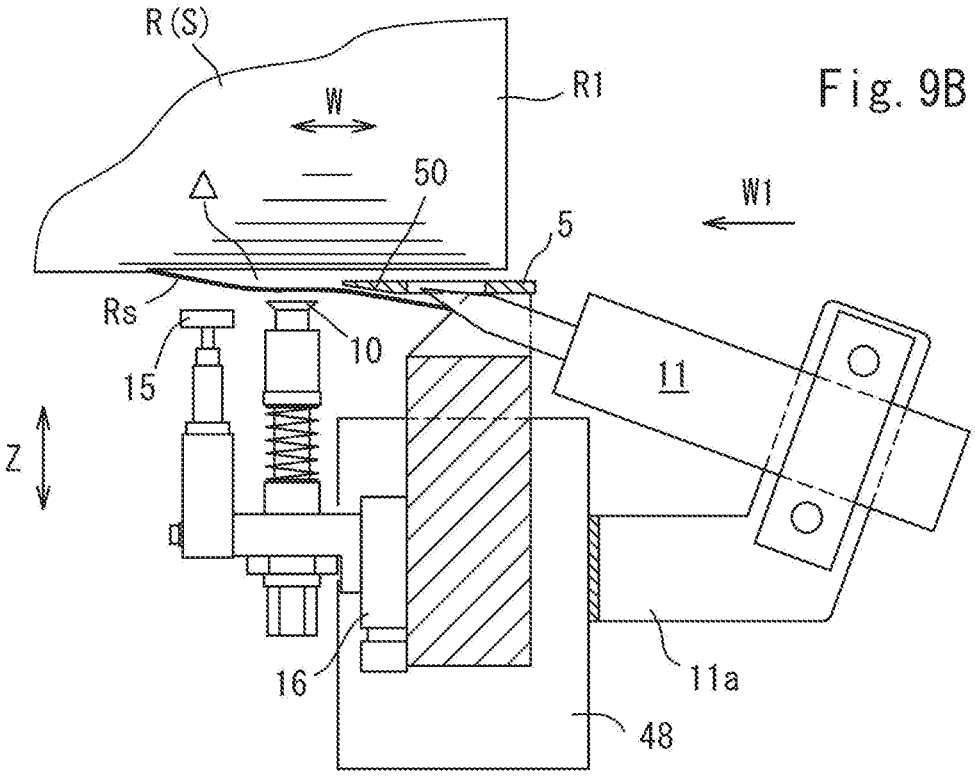

As shown in FIG. 9A and FIG. 9B, the intrusive tool 5 intrudes in the air gap Δ. The first cutter 11 is arranged slightly backward from a tip end of the intrusive tool 5.

The intrusive tool 5 composes a moving blower 50. The moving blower 50 blows intrusive air A2 of FIG. 8A toward the air gap Δ, and is mounted in the moving device 4 (FIG. 6). Note that blowing of the intrusive air A2 is controlled by the control device 100 and a valve not shown.

Figure 7B:
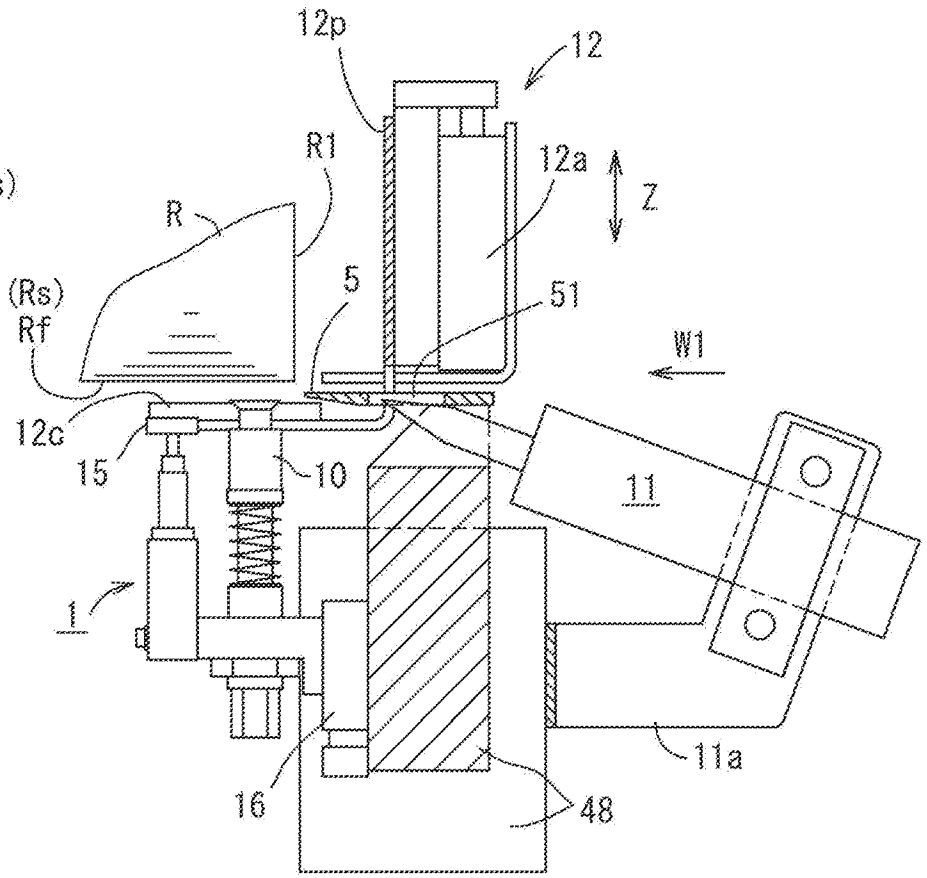
FIG. 7A and FIG. 7B are a schematic front view and a schematic side view, respectively, in partial cross-section showing the first cutting device and a pressing tool in an origin position.
Figure 7A:
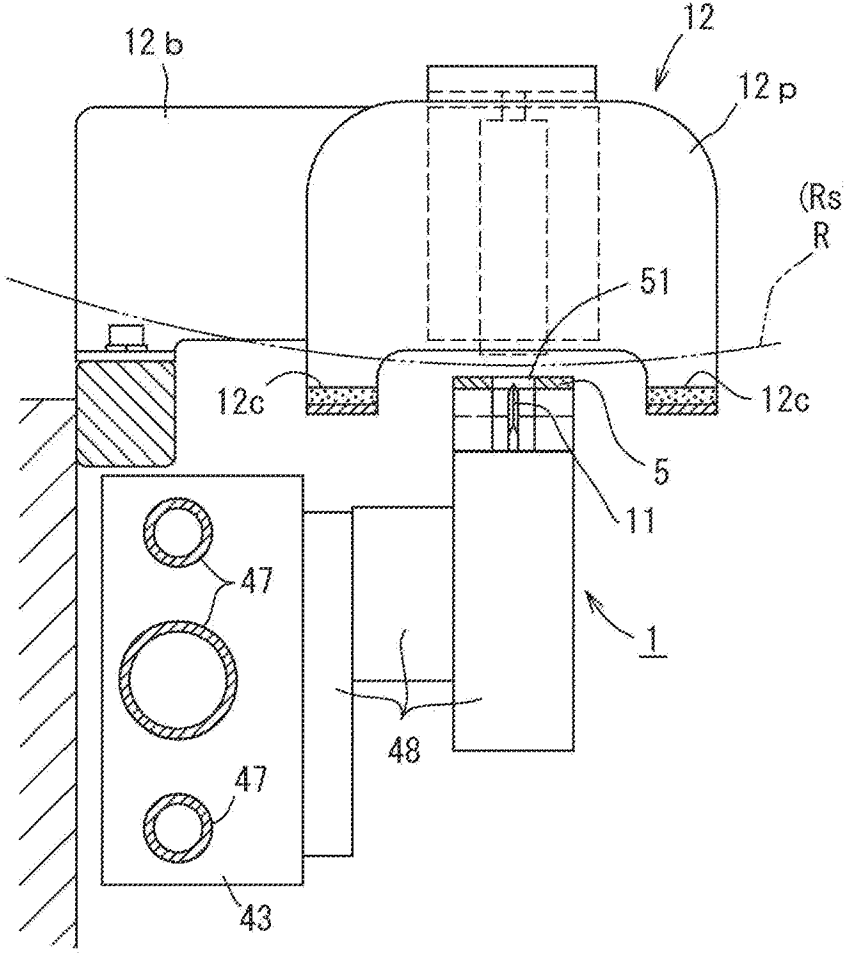

As shown in FIG. 7A and FIG. 7B, the first cutting device 1 includes a pressing tool 12. The pressing tool 12 presses the outermost layer Rs toward the center of a radial direction Z of the rollstock R on both sides, away from the first cutter 11, in the first edge portion R1.

Next, structures of the first and second cutting devices 1, 2 of FIG. 4 will be described.

The first cutting device 1 and the second cutting device 2 have a first outer diameter setting device 61 and a second outer diameter setting devices 62, respectively. The moving device 4 of the first cutting device is mounted to the first outer diameter setting device 61. The second cutting device 2 and the drawing device 3 are mounted in the second outer diameter setting device 62.

The first and second outer diameter setting devices 61, 62 are configured such that positions in the radial direction Z of the first and second cutting devices 1, 2 are positions corresponding to an actual outer diameter of the rollstock R. The first outer diameter setting device 61 will be described as a representative example of the structures of these setting devices 61, 62.

Figure 5:
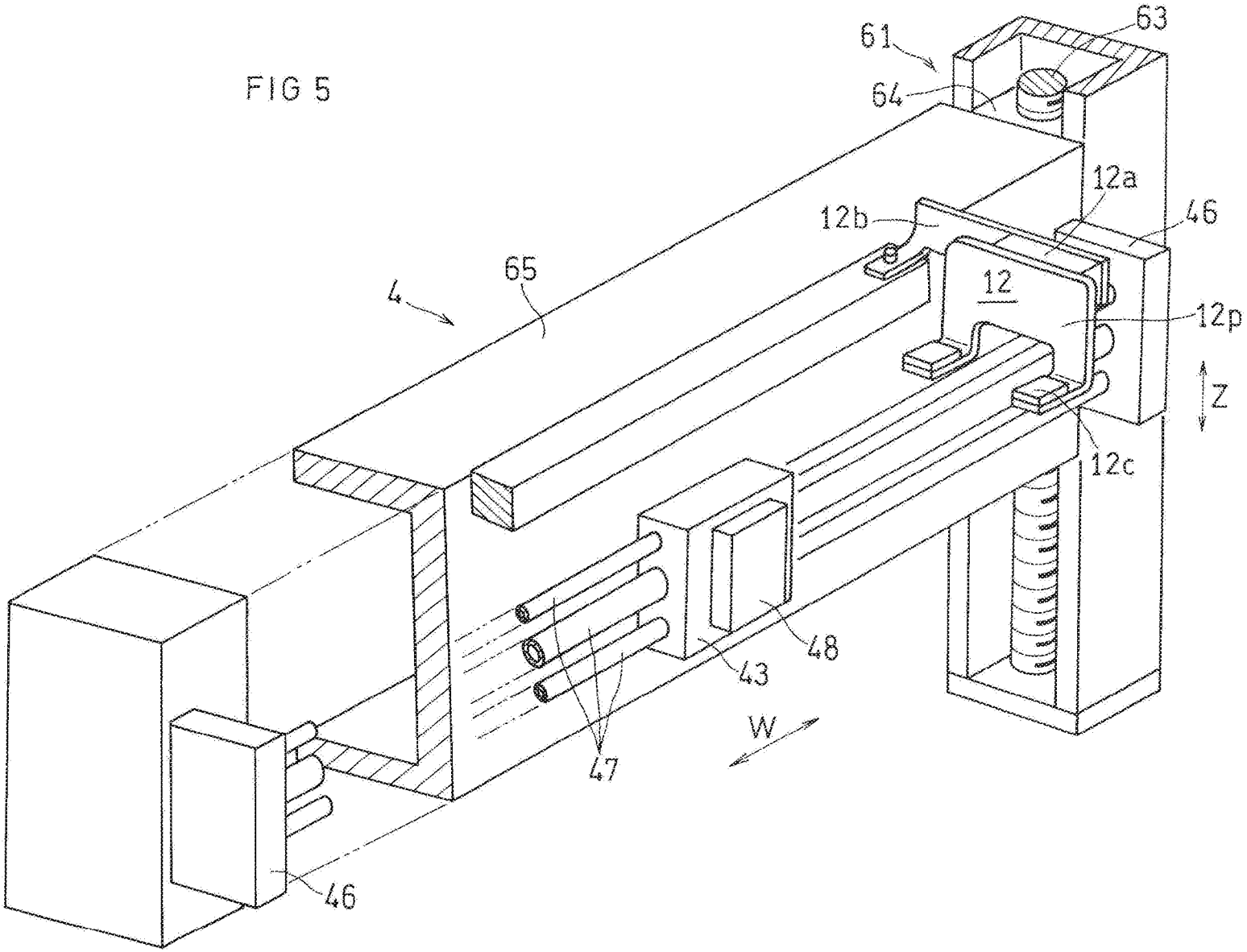
FIG. 5 is a schematic perspective view in partial cross-section showing a moving device.

The first outer diameter setting device 61 has a screw shaft 63 of FIG. 5 that is driven by a motor M. A movable frame 65 is attached to a female screw 64 that is screwed into the screw shaft 63. Note that the motor M may not be provided, and a manual setting instead may be performed.

When a position of the unwinding roller 9 that supports the rollstock R can be controlled by a robot arm provided with the unwinding roller 9 of FIG. 4, the outer diameter setting devices 61, 62 may be omitted so that the first and second cutting devices 1, 2 are arranged unmovably to the radial direction Z.

Next, the moving device 4 will be described with reference to FIG. 4 to FIG. 6.

The moving device 4 moves main components of the first cutting device 1 from an origin position (an original set position) indicated by a dashed-two dotted line of FIG. 6 to a moving end position indicated by a solid line.

As shown in FIG. 5, the moving device 4 includes: a pair of end portion plates 46 fixed to the movable frame 65; three rods 47 that are parallel to each other and are bridged between the pair of end portion plates 46, 46; and a slider 43. The slider 43 may be configured to reciprocate along the rods 47 by a known linear motor.

A moving unit 48 is fixed to the slider 43, and the first cutter 11 and the intrusive tool 5 are fixed to the moving unit 48 of FIG. 6. The touch sensor 15 and the vacuum pad 10 are attached to the moving unit 48 via an air cylinder 16.

Figure 8A:
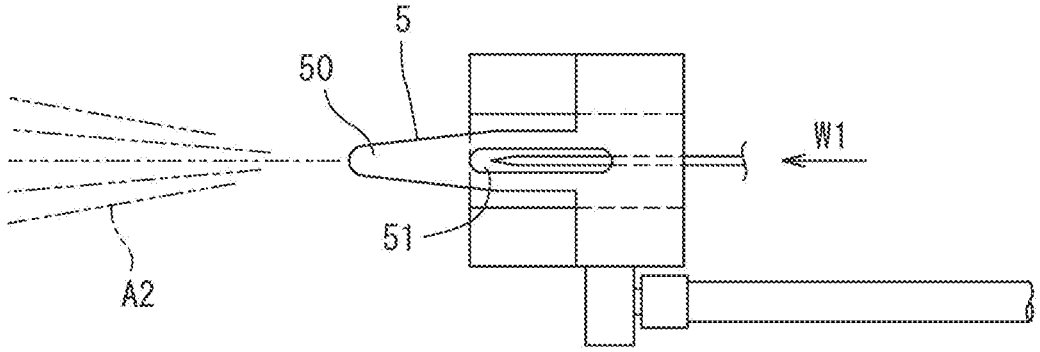
FIG. 8A is a schematic plan view showing a moving blower.
Figure 8B:
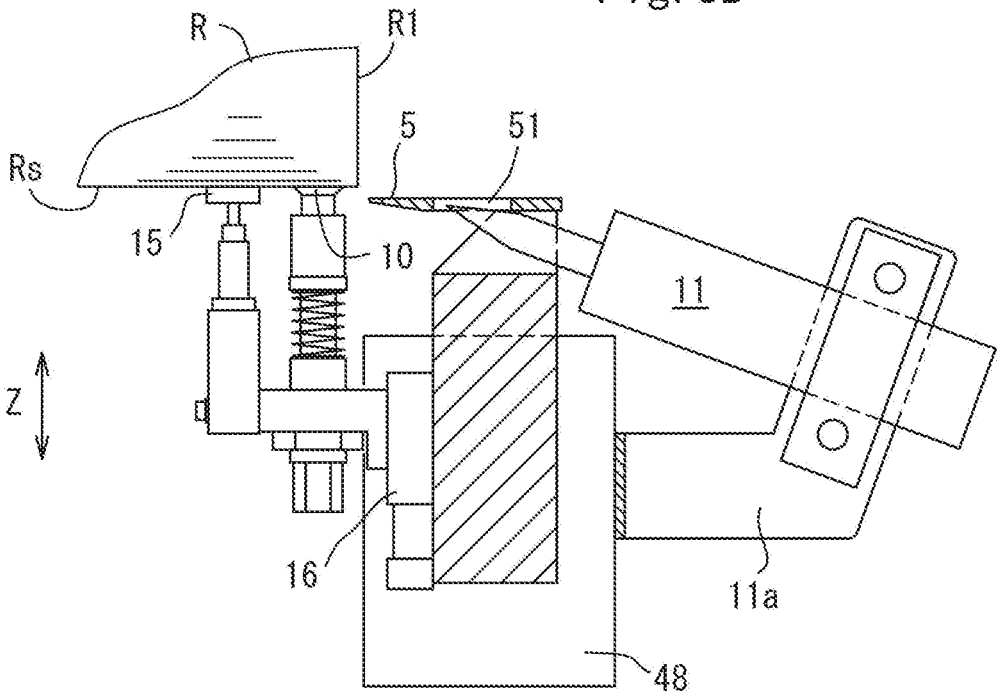
FIG. 8B is a schematic side view in partial cross-section of the first cutting device in a state where a vacuum pad is ascended.

As shown in FIG. 8B, the touch sensor 15 moves in the radial direction Z by ascending operation of the air cylinder 16, contacts with the rollstock R, and outputs a signal indicating contact with the rollstock R to the control device 100. At this time, the vacuum pad 10 also contacts with the outermost layer Rs of the rollstock R.

After the contact, the vacuum pad 10 of FIG. 9A absorbs with a negative pressure the outermost layer Rs, and the air cylinder 16 is descended in this state of activating the negative pressure absorption, and separates the outermost layer Rs from an inner layer of the rollstock R. This generates the air gap Δ.

Next, details of the first cutting device 1 will be described.

The first cutting device 1 of FIG. 4 is arranged in an upper part (area) than the unwinding roller 9 so as to be able to cut the outermost layer Rs in an upper part than the unwinding roller 9.

The first cutter 11 of FIG. 8B may be, for example, a known ultrasonic cutter. The first cutter 11 is fixed to the moving unit 48 via an arm 11*a*. A blade edge of the first cutter 11 enters into a penetrating slit 51 of the intrusive tool 5.

As shown in FIG. 7A and FIG. 7B, the intrusive tool 5 is arranged in a position that is slightly away from the outer circumferential surface Rf and an end surface of the rollstock R, in the origin position. On the other hand, as shown in FIG. 9A and FIG. 9B, when the outermost layer Rs is separated from the rollstock R, the tip end of the intrusive tool 5 faces the air gap Δ.

As indicated by a dashed-two dotted line of FIG. 8A, the intrusive tool 5 composes the moving blower 50 that discharges the intrusive air A2 from its tip end toward the air gap Δ (FIG. 9A). An air passage and an air nozzle that continue to an air source not shown is formed in the intrusive tool 5.

As shown in FIG. 9B, the first cutter 11, the intrusive tool 5, and the moving blower 50 move in the first width direction W1 by the movement of the moving unit 48. This movement secures the air gap Δ in between the outermost layer Rs and the inside layer of the rollstock R. At the same time, by the movement, the first cutter 11 cuts only the outermost layer Rs.

Next, the pressing tool 12 of the first cutting device 1 of FIG. 5 to FIG. 7B will be described.

The pressing tool 12 of FIG. 5 is configured such that a plate 12*p* drives with regard to a bracket 12*b* in the radial direction Z via an air cylinder 12*a*. In the case of this example, a pair of pressing units 12*c* having a large friction force is arranged a tip end of the plate 12*p*. Note that the pair of pressing units 12*c* may be composed of a pair of free rollers or the like.

As shown in FIG. 7A, the pressing units 12*c* are arranged in both sides of a circumferential direction with respect to the first cutter 11, and press the outermost layer Rs of the rollstock R toward the rollstock R during cutting by the first cutter 11. That is, the pressing units 12*c* of FIG. 7B move toward the center of the radial direction Z of the rollstock R in a period from immediately before the cutting by the first cutter 11 until before the drawing of the outermost layer Rs. The pressing units 12*c* press the outermost layer Rs.

Next, the second cutting device 2 and the drawing device 3 of FIG. 2 to FIG. 4 will be described.

The second cutting device 2 and the drawing device 3 of FIG. 4 are arranged in a lower position that is lower than the unwinding roller 9, and is away from the first cutting device 1 by about 90° in the circumferential direction.

Figure 3A:
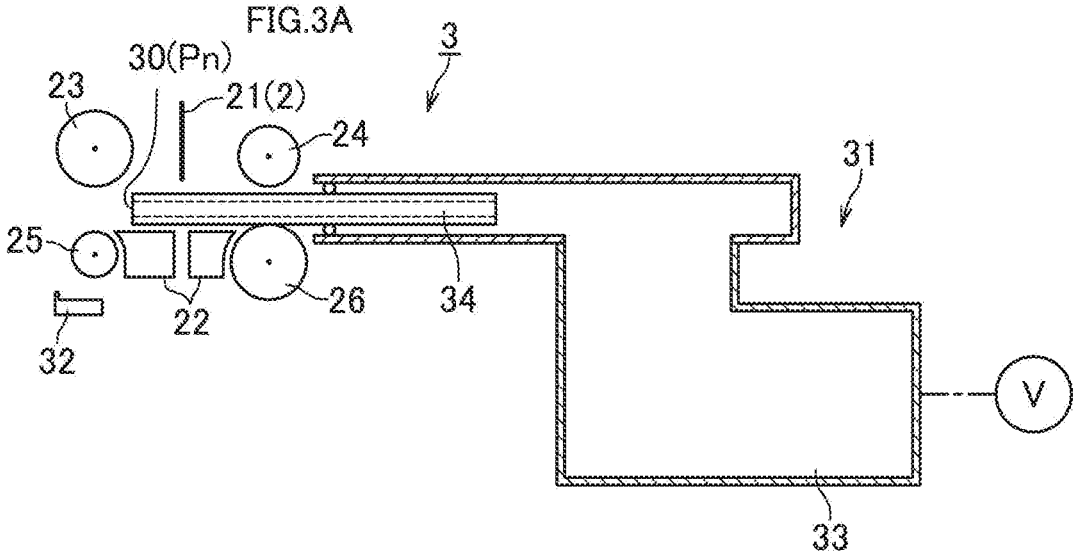
FIG. 3A and FIG. 3B are schematic side views each showing a drawing device.

In FIG. 3A, the drawing device 3 has an accommodation chamber 33 connected to a negative pressure source. A flat cylindrical suction pipe 34 is provided in the accommodation chamber 33 so as to be able to reciprocate between the proximal position Pn of FIG. 3A and the distal position Pf of FIG. 3B.

Figure 3B:
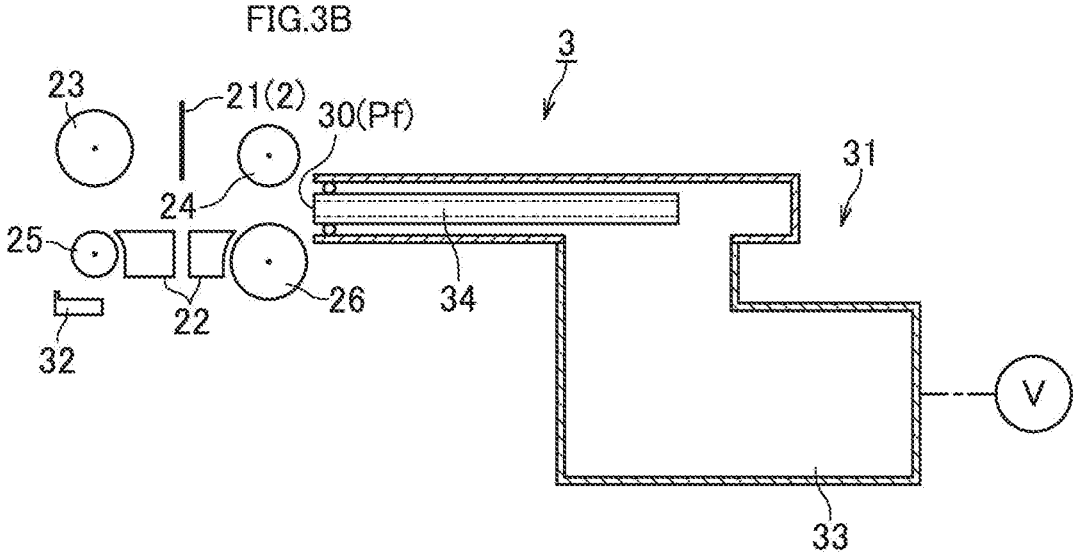

The second cutting device 2 is arranged in the suction port 30 side of the accommodation chamber 33 of FIG. 3B. The second cutting device 2 includes an anvil 22, two movable rollers 23, 24, and two fixed rollers 25, 26.

The first control unit 101 of FIG. 4 rotates the unwinding roller 9 (FIG. 4) together with the rollstock R in the first circumferential direction D1, after the cutting of FIG. 1(*b*) by the first cutting device 1, until before the cutting by the second cutter 21 of FIG. 1(*c*) to (*f*), and rotates the unwinding roller 9 (FIG. 4) together with the rollstock R in the second circumferential direction D2 opposite from the first circumferential direction D1 after the cutting by the second cutter 21 of FIG. 1(*g*), (*h*).

Before the cutting by the second cutter 21, the second control unit 102 of FIG. 4 controls the suction device 31 such that the suction port 30 is in the proximal position Pn as FIG. 2(*a*) to (*c*), and the suction port 30 is in the distal position Pf at the time of cutting by the second cutter 21 of FIG. 2(*d*) to (*g*).

Details of the method of discarding the outermost layer Rs after the first cutting step will be described below.

After the first cutting step of FIG. 1(*b*), the rollstock R is rotated in the first circumferential direction D1 in the drawing step of FIG. 1(*c*) to (*f*). The first circumferential direction D1 is set to be the unwinding direction for generating a product from the film S.

The rollstock R of FIG. 6 is rotatably supported around a horizontal axis line H by the unwinding roller 9. In the step of rotating in the first circumferential direction D1 of FIG. 1(*c*) to (*f*), the rollstock R is rotated in the first circumferential direction D1 such that the cut first end S11 of the film S moves from an upward position to a downward position.

As shown in FIG. 2(*a*), before the first end S11 approaches the suction port 30, the air is blown from the air blower 32 in a direction in which the first end S11 is turned up (taken up). At the same time, the accommodation chamber 33 of FIG. 3A and an inside of a narrow passage in the suction pipe 34 are brought into a negative pressure, and the first end S11 is sucked into the suction pipe 34 along the roller 23 as FIG. 2(*b*).

As shown in FIG. 2(*c*), when a part of the film S is sucked into the suction pipe 34, the suction pipe 34 in the proximal position Pn moves to the distal position Pf of FIG. 2(*d*). After this movement, as FIG. 2(*e*), the roller 23 approaches a roller 25, and a nip roller 24 nips the film S between the nip roller 24 and a roller 26.

After that, as FIG. 2(*f*) and FIG. 1(*h*), the second cutter 21 cuts the film S in the second cut portion C2, the film S continuing from the outermost layer Rs to the base end Sb before this cutting. After the cutting, nipping by the nip rollers 24, 26 are released, and the cut ends S1, S2 of FIG. 1(*d*) and FIG. 1(*h*) are sucked and accommodated into the accommodation chamber 33 of FIG. 3B.

Note that the length of the film S from the tip end Se of the film S of FIG. 1(*a*) to the second cut portion C2 of FIG. 1(*i*) is longer than the length of one round of the outermost circumference of the rollstock R.

As shown in FIG. 2(*g*) and FIG. 1(*i*) to FIG. 1(*j*), after the second cutting step, the rollstock R is rotated in the second circumferential direction D2 opposite from the first circumferential direction D1. The tip end of the rollstock R from which the outermost layer Rs has been cut and removed is set in a predetermined position required in a subsequent processing step.

Next, details of an example of the cutting method by the first cutting device 1 of FIG. 6 will be described.

In the present example, the cutting method of the present example is a method for cutting only the film S in the outermost circumference of the rollstock R over the overall width of the width direction W of the film S, and includes a pressing step, a separation step, an intrusion step, a displacement step, and a cutting step described below.

In the pressing step, the pair of pressing units 12*c* of the pressing tool 12 shown in FIG. 7A and FIG. 7B are pressed against the rollstock R. Thereby, the outermost layer Rs of the rollstock R is maintained in a stable state where positional deviation is hard to occur in the radial direction Z and the first width direction W1, in the first edge portion R1.

That is, before the cutting step, the outermost layer Rs is pressed toward the center side of the radial direction Z of the rollstock R by the pair of pressing units 12*c* of the pressing tool 12 in the both sides of the circumferential direction of the first cutter 11 in the first edge portion R1. The cutting step is performed in this pressing state. Note that the pressing step is performed prior to the separation step.

In the separation step, in the state where the outermost layer Rs composing the film S in the outermost circumference of FIG. 1(*a*) is remained to be wound as a part of the rollstock R, in the first edge portion R1 of the width direction W the outermost layer Rs is separated from the film S of the inner circumferential side of the outermost layer Rs of FIG. 9A in the radial direction Z of the rollstock R, and thereby the air gap Δ is generated in between the film S of the inner circumferential side of the outermost layer and the outermost layer Rs.

In this example, the film S is formed of an air impermeable resin film, and, for example, the outermost layer Rs is sucked in the first edge portion R1 so that the air gap Δ is generated in between the film S of the inner circumferential side of the outermost layer Rs and the outermost layer Rs, and thereby, the separation step is performed.

More specifically, the separation step is performed as below.

The touch sensor 15 of FIG. 7B and the vacuum pad 10 move in the radial direction Z until contacting the outermost layer Rs of the rollstock R of FIG. 8B due to actuation of the air cylinder 16. When the contact is detected by the touch sensor 15, the vacuum pad 10 absorbs the outermost layer Rs with a negative pressure. After that, the vacuum pad 10 moves in the radial direction Z away from the rollstock R as FIG. 9A due to the actuation of the air cylinder 16. Thereby, the air gap Δ is generated.

In the intrusion step, as FIG. 9B, after the separation step, in the first edge portion R1, the intrusive tool 5 and the first cutter 11 are intruded in between the outermost layer Rs and the film S of the inner circumferential side. In this intrusion step and the displacement step, while the intrusive tool 5 advances in the first width direction W1 in the air gap Δ, the moving blower 50 continues to discharge the air in the first width direction W1.

In the displacement step, a portion of the outermost layer Rs defining the air gap Δ is displaced in the first width direction W1 heading from the first edge portion R1 of FIG. 6 to a second edge portion R2 of the width direction W of the outermost layer Rs.

In this example, while the moving blower 50 of the intrusive tool 5 that blows the air to the air gap Δ of FIG. 9B blows air, the intrusive tool 5 moves in the first width direction W1 together with the first cutter 11, and thereby, the displacement step is performed.

In the cutting step, during the displacement step, while the first cutter 11 is moved from the first edge portion R1 to the second edge portion R2 of FIG. 6, the outermost layer Rs is cut over the overall width of the width direction W.

More specifically, the displacement step and the cutting step are performed as below. The intrusive tool 5 and the first cutter 11 mounted in the slider 43 of FIG. 6 move together with the slider 43 from the origin position indicated by the dashed-two dotted line of FIG. 6 to the moving end position indicated by the solid line. By this movement, as FIG. 9B, while the moving blower 50 arranged in front of the first cutter 11 blows the air, the blade of the first cutter 11 contacts with the outermost layer Rs in the state where the air gap Δ is secured, and the outermost layer Rs is cut over the overall width of the width direction W of FIG. 6.

After the cutting described above, the intrusive tool 5 and the first cutter 11 return to the origin position indicated by the dashed-two dotted line together with the slider 43.

In the example described above, the first cutter 11 is the ultrasonic cutter. However, the first cutter 11 may be composed of a sharp roller, an anvil, or the like. It is preferable that a device for performing the separation step and the first cutting step is selected depending on a type of the film S that is a target.

For example, when the film S is the resin film or a non-woven fabric, instead of the vacuum pad 10, a pair of engaging rollers having a plurality of hooks in an outer circumferential surface may be provided to stretch (pull) the outermost layer Rs in the radial direction Z so that the air gap Δ is formed.

In the separation step, only the outermost layer Rs is separated from the rollstock, and only the outermost layer Rs is cut in the first cutting step. However, the outermost layer Rs formed of a non-woven fabric and the film in the inner layer may be sucked by the vacuum pad 10, or the outermost layer Rs and the film in the inner layer of the outermost layer Rs may be hooked by the hook of the engaging roller. In this case, as FIG. 10, a two-layer film including the outermost layer is cut and removed. Specifically, the two-layer film formed of the outermost layer and the film of the second layer from the outermost circumference may be separated from the film in the inner circumferential side (from the outermost circumference to the film of the third layer), and the air gap Δ may be generated in between the two-layer film and the layer of the third layer. In this case, the two-layer film (the outermost layer and the film of the second layer) including the outermost layer is cut in the first cutting step.

In the present invention, the air gap generated in between the film of the inner circumferential side of the outermost layer and the outermost layer refers to an air gap generated in a surface layer portion of the rollstock. Thus, the air gap Δ may be generated by separating only the outermost layer from the film of further inner circumferential side than the outermost layer, or the air gap may be generated by separating two or more layers of the outer circumferential side layers including the outermost layer, from the layer of further inner circumferential side than the layers of the outer circumferential side.

An example of FIG. 10 will be briefly described below.

Figure 10:
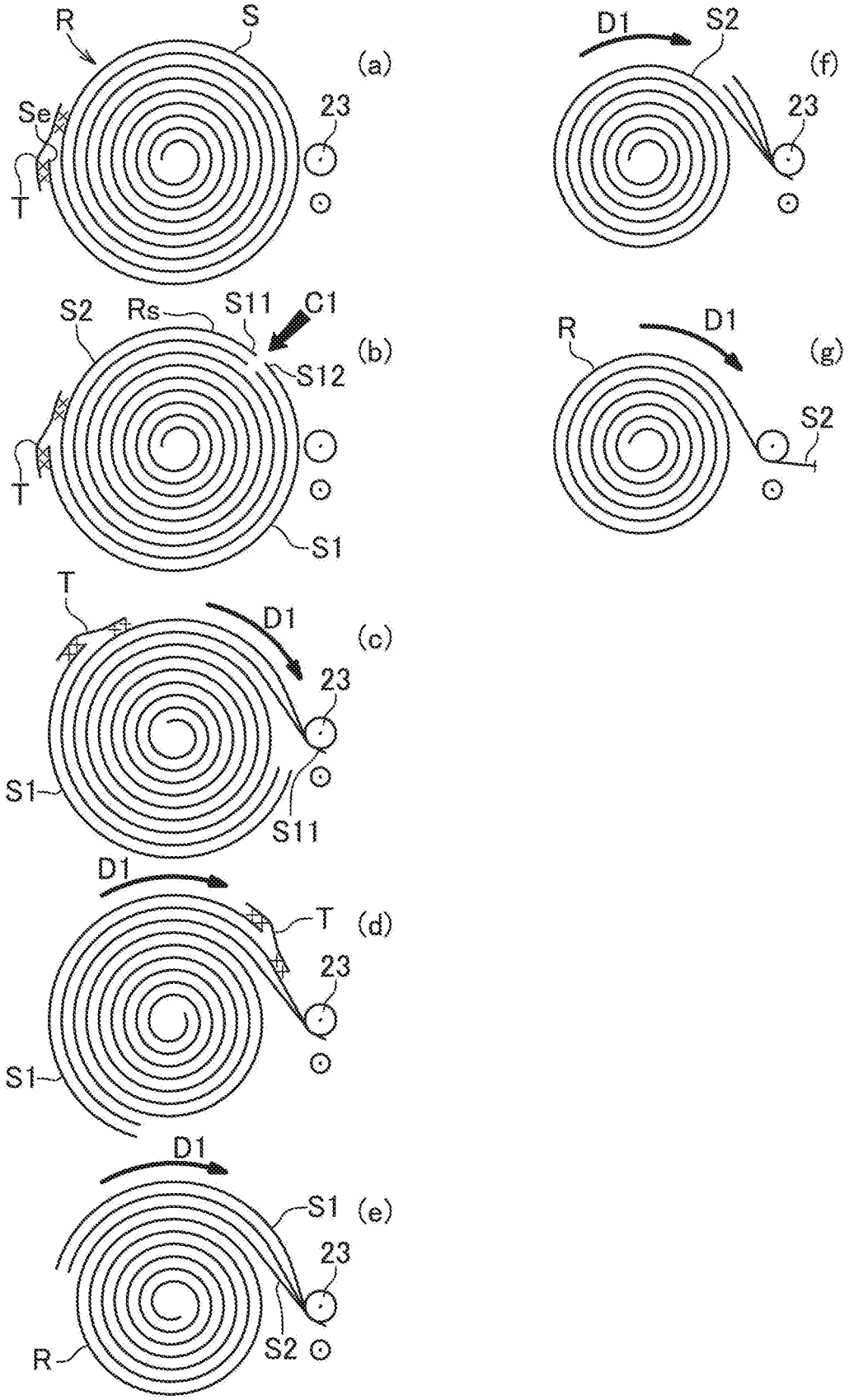
FIG. 10 is a process drawing showing Second Example of a removal method of an outermost layer.

The outermost layer Rs and the inner layer of the film S of FIG. 10(*a*) are cut as FIG. 10(*b*). After that, the film S is drawn as FIG. 10(*c*) to (*g*).

Also in this case, the second cutting step is necessary. In FIG. 10(*c*) to (*g*), the cut piece of the film S formed by the outermost layer and the inner layer that have been cut is drawn together with the film continuing to the base end. After that, processing is performed as similar to FIG. 1(*f*) to (*j*), and the tip end of the film is rewound to a predetermined position.

In each example described above, the film S is drawn by rotating the rollstock R after the first cutting step in the same direction as the unwinding direction at the time of product processing. However, as shown in the example of FIG. 11, the film S can be drawn by rotating the rollstock R in the opposite direction from the unwinding direction at the time of product processing.

Figure 11:
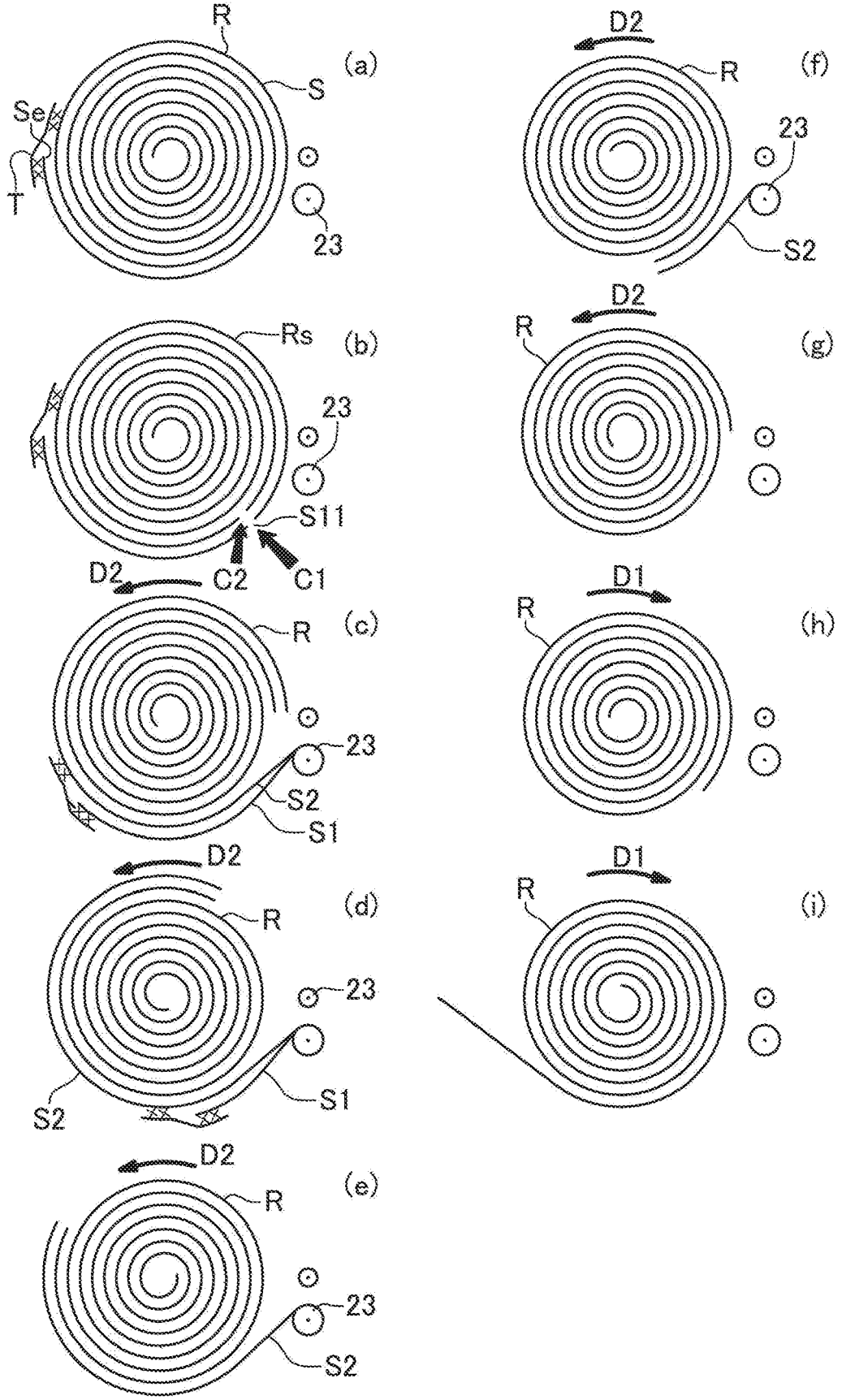
FIG. 11 is a process drawing showing Third Example of a removal method of an outermost layer.

That is, in the example of FIG. 11, after the film S of the rollstock R of FIG. 11(*a*) is cut in two layers of the outermost layer Rs of FIG. 11(*b*) and the inner layer, the rollstock R is rotated in the second circumferential direction D2 opposite from the unwinding direction of FIG. 11(*c*), and the cut film S is drawn and discarded as FIG. 11(*d*) to (*g*). In this case, both the first and second cutting steps are performed by the cutting of FIG. 11(*b*). The second cutter and the second cutting device are not necessary.

In this example, both the first cutting step with respect to the outermost layer Rs and the second cutting step with respect to the inner layer of the outermost layer Rs are performed by the cutting of FIG. 11(*b*).

Note that, after the rotation in the second circumferential direction D2, as FIG. 11(*g*) to (*i*), the rollstock R is rotated in the first circumferential direction D1 and is unwound for predetermined processing.

FIG. 11(*g*) shows operation of setting a new tip end of the film in a predetermined position, and the operation is included in the present removal method. However, steps of FIG. 11(*h*) to (*i*) are not included in the outermost layer removal method, and of another connection.

Figure 12:
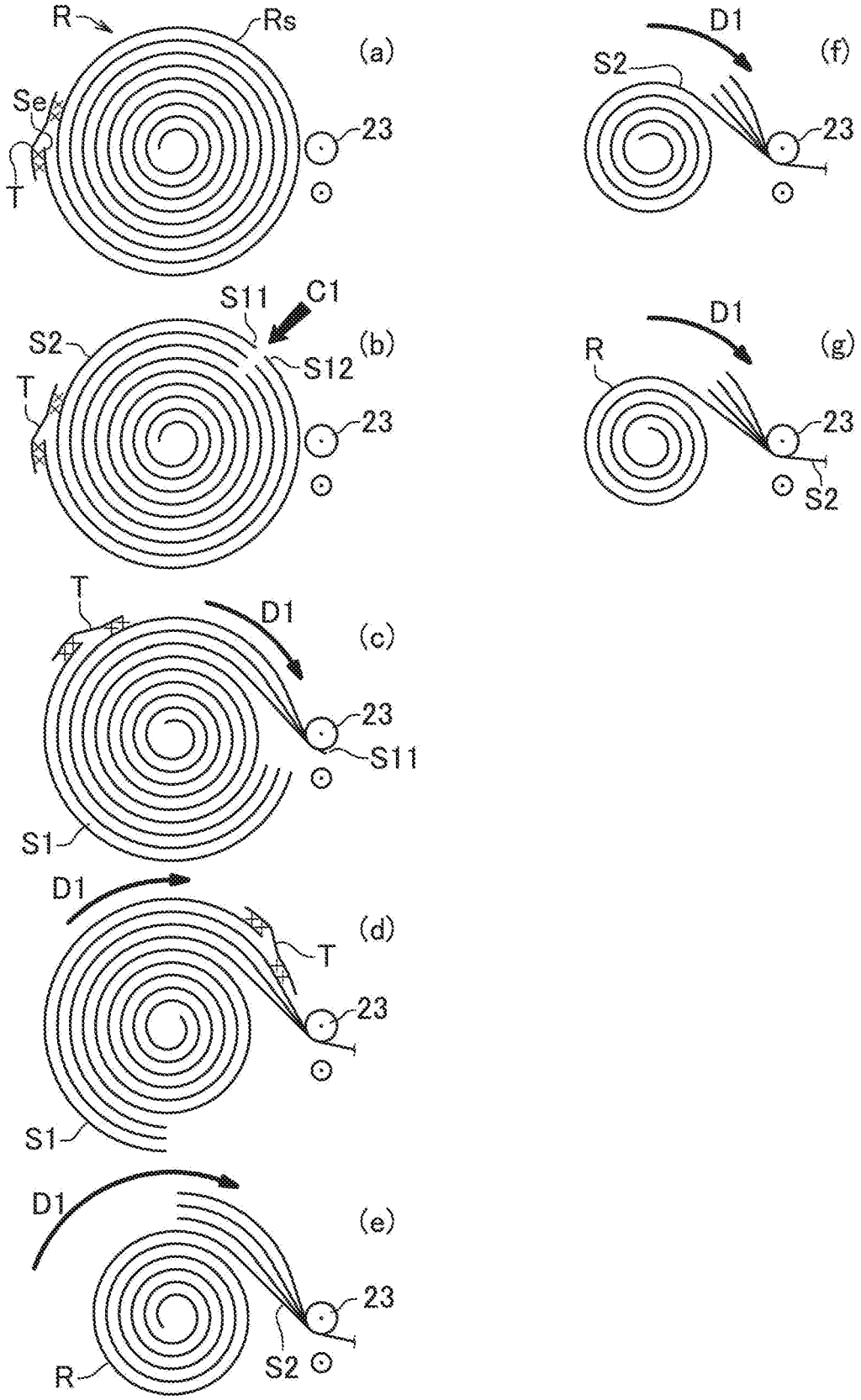
FIG. 12 is a process drawing showing Fourth Example of a removal method of an outermost layer.

As shown in FIG. 12(*a*) to (*g*), three layers including the outermost layer Rs of the rollstock R may be cut. In this case, after the drawing step of FIG. 12(*g*), the second cutting step is performed.

The film may be a liquid absorbing paper. In this case, an adhesive tape may be adhered to an outermost layer of the rollstock of the liquid absorbing paper and the first cutting step may be performed by tearing out the liquid absorbing paper together with the adhesive tape.

As described above, preferred examples have been described with reference to the drawings. However, a skilled person in the art will readily conceive of numerous changes and modifications within a scope apparent, by looking at the present specification.

For example, the outermost layer of the rollstock may be adhered to the rollstock by an adhesive or a bonding agent, instead of the tape or the like.

The moving device may reciprocate by a belt or the like instead of the linear motor.

The pressing tool is not always necessary. The pressing unit of the pressing tool may be a free roller other than the rubber plate.

Accordingly, such changes and modifications are intended to be within the scope of the present invention as defined by the appended claims.

INDUSTRIAL APPLICABILITY

The method and the system of the present invention can be utilized for various rollstocks, in addition to production of a disposable wearable article such as disposable shorts, a diaper, a sanitary napkin, or the like.

REFERENCE SIGNS LIST

1: First cutting device, 10: Vacuum pad, 11: First cutter, 12: Pressing tool

13: Blower, 15: Touch sensor, 16: Air cylinder

2: Second cutting device, 21: Second cutter; 22: Anvil, 23 to 26: Roller

3: Drawing device, 30: Suction port, 31: Suction device, 32: Air blower

4: Moving device, 43: Slider

5: Intrusive tool, 50: Moving blower, 51: Penetrating slit

61, 62: Outer diameter setting device

9: Unwinding roller, 91: Sensor

100: Control device, 101: First control unit, 102: Second control unit,

103: Third control unit

C1: First cut portion, C2: Second cut portion

D1: First circumferential direction, D2: Second circumferential direction, H: Horizontal axis line Pf: Distal position, Pn: Proximal position R: Rollstock, R1: First edge portion, R2: Second edge portion, Rc: Hollow portion, Rf: Outer circumferential surface Rs: Outermost; layer S1: First cut piece, S2: Second cut piece, S11: First end, S12: Second end S: Film, Sb: Base end, Se: Tip end T: Tape, W: Width direction, W1: First width direction, Z: Radial direction, Δ: Air gap

The invention claimed is:

1. A method for removing an outer layer of a rollstock comprising:

a first cutting step of cutting a film of a rollstock in an outermost circumference of the rollstock along an overall width of a width direction in a first cut portion in the outermost circumference of the rollstock, the rollstock formed by rolling the film from a base end of the film to a tip end of the film into the rollstock and then temporarily fixing the tip end to an outer circumferential surface of the rollstock;

a second cutting step of cutting the film along the overall width of the width direction in a second cut portion, a length of the film from the second cut portion to the base end being shorter than a length of the film from the first cut portion to the base end, a length of the film from the tip end to the second cut portion being equal to or more than a length of one round of the outermost circumference of the rollstock; and a step of discarding a first cut piece of the film extending to the tip end from the first cut portion and a second cut piece of the film extending to the second cut portion from the first cut portion by drawing the first cut piece and the second cut piece with a drawing device while driving an unwinding roller mounted with a hollow portion of the rollstock to rotate.

2. The method for removing an outer layer of a rollstock according to claim 1, further comprising a drawing step of drawing from the rollstock a first end continuing to the base end, the first end being one of a pair of ends of the film, the pair of ends formed by cutting the film in the first cutting step, wherein the film continuing to the first end that has been drawn is cut in the second cut portion, in the second cutting step.

3. The method for removing an outer layer of a rollstock according to claim 2, further comprising:

a step of rotating the rollstock in a first circumferential direction in the drawing step; and a step of rotating the rollstock in a second circumferential direction opposite from the first circumferential direction after the second cutting step.

4. The method for removing an outer layer of a rollstock according to claim 2, wherein only an outermost layer configuring the film in the outermost circumference of the rollstock is cut in the first cutting step, and the film continuing from the outermost layer to the base end is cut in the second cutting step.

5. The method for removing an outer layer of a rollstock according to claim 4, further comprising:

a step of rotating the rollstock in a first circumferential direction in the drawing step, the first circumferential direction set in an unwinding direction for producing a product from the film; and a step of rotating the rollstock in a second circumferential direction opposite from the first circumferential direction after the second cutting step.

6. The method for removing an outer layer of a rollstock according to claim 3, wherein the rollstock is rotatably supported around a horizontal axis line by the unwinding roller, and the rollstock is rotated such that the first end of the film moves from upward to downward in the step of rotating the rollstock in the first circumferential direction.

7. The method for removing an outer layer of a rollstock according to claim 1, wherein a length of the film from the first cut portion to the second cut portion is longer than a length of one round of the outermost circumference of the rollstock.

8. The method for removing an outer layer of a rollstock according to claim 7, wherein the tip end of the film of the rollstock is temporarily fixed to the outer circumferential surface of the rollstock with a tape, and the first and second cut portions are set in portions of the film, the portions being not covered with the tape.

9. A system for removing an outer layer of a rollstock comprising: an unwinding roller mounted with a hollow portion of a rollstock, the rollstock formed by rolling a film from a base end of the film to a tip end of the film into the rollstock;

a first cutter that cuts the film in an outermost circumference of the rollstock along an overall width of a width direction, in a first cut portion in the outermost circumference of the rollstock mounted in the unwinding roller;

a suction device that sucks with a negative pressure a first end continuing to the base end of the film and draws the first end from the rollstock, the first end being one of a pair of ends of the film, the pair of ends formed by cutting the film by the first cutter; and a second cutter that cuts the film drawn by the suction device along the overall width of the width direction, in a second cut portion, wherein the suction device has a suction port, and the suction device is configured such that the suction port reciprocates between a distal position and a proximal position, wherein, at the proximal position, a distance from the suction port to the unwinding roller is smaller than a distance from the second cutter to the unwinding roller, and wherein, at the distal position, the distance from the suction port to the unwinding roller is larger than the distance from the second cutter to the unwinding roller.

10. The system for removing an outer layer of a rollstock according to claim 9, further comprising an air blower positioned between the second cutter and the unwinding roller, the air blower separating one of the pair of ends of the film from the rollstock by air blowing.

11. The system for removing an outer layer of a rollstock according to claim 9, further comprising a first control unit configured to rotate the unwinding roller together with the rollstock in the first circumferential direction corresponding to an unwinding direction, after cutting the film by the first cutter and until before cutting the film by the second cutter, and rotate the unwinding roller together with the rollstock in the second circumferential direction opposite from the first circumferential direction, after cutting the film by the second cutter.

12. The system for removing an outer layer of a rollstock according to claim 9, further comprising a second control unit configured to control the suction device such that the suction port is in the proximal position before cutting the film by the second cutter, and is in the distal position when cutting the film by the second cutter.

* * * * *